US006021531A

United States Patent [19]

Kirko

[11] Patent Number: 6,021,531

[45] Date of Patent: Feb. 8, 2000

[54] PORTABLE UNISEX URINAL

[76] Inventor: Edward J. Kirko, 220 Essex Rd., Old Saybrook, Conn. 06475

[21] Appl. No.: 09/165,390

[22] Filed: Oct. 2, 1998

[51] Int. Cl.[7] ..... A47K 11/12

[52] U.S. Cl. ..... 4/144.3; 4/144.1

[58] Field of Search ..... 4/144.1, 144.3, 4/114.1, 462, 463, 479, 480; 141/340, 341

[56] References Cited

U.S. PATENT DOCUMENTS

| | | | |
|---|---|---|---|
| 105,979 | 8/1870 | Price | 4/144.1 |
| 2,524,243 | 10/1950 | Wicklund | 141/341 X |
| 2,536,419 | 1/1951 | Brunell et al. | 141/341 |
| 2,956,287 | 10/1960 | Stanford . | |
| 3,000,015 | 9/1961 | Hart | 4/144.3 |
| 4,050,103 | 9/1977 | Nakao et al. | 4/144.3 X |
| 4,117,845 | 10/1978 | Brown | 4/114.1 X |
| 4,121,306 | 10/1978 | Bringman et al. | 4/144.3 X |
| 4,422,188 | 12/1983 | Strutton et al. | 4/144.1 |
| 5,010,599 | 4/1991 | Nilsson . | |
| 5,285,532 | 2/1994 | Sealy | 4/144.3 |
| 5,331,689 | 7/1994 | Haq | 4/144.1 |
| 5,551,097 | 9/1996 | Short | 4/144.1 X |
| 5,655,229 | 8/1997 | Horn | 4/144.3 |

FOREIGN PATENT DOCUMENTS

| | | | |
|---|---|---|---|
| 906726 | 9/1962 | United Kingdom | 4/144.1 |

*Primary Examiner*—Henry J. Recla
*Assistant Examiner*—Kathleen J. Prunner
*Attorney, Agent, or Firm*—Robert H. Montgomery

[57] ABSTRACT

A urinal comprises an open top bucket-like member having a shaft fastened to and extending upwardly therefrom. A urine input member having a generally funnel shaped upper portion and a lower flexible portion is slideaby mounted to the shaft. A urine receptacle is disposed on the bucket-like member and is removable therefrom. Tubing extends from the lower portion of the input member to the receptacle and is removable therefrom and a weighting member in or fastener attached to the bucket-like member effect stabilization of the urinal in a selected location.

10 Claims, 1 Drawing Sheet

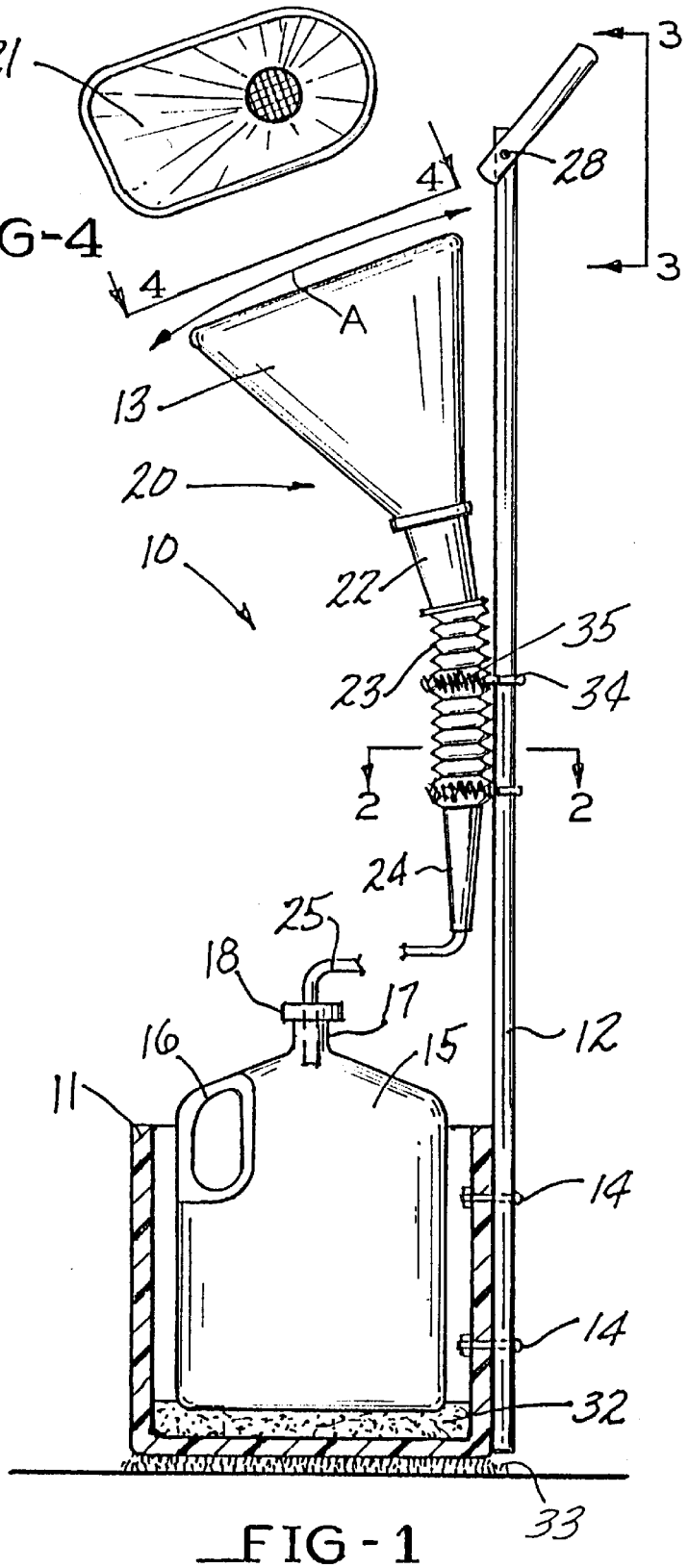
FIG-4
FIG-1
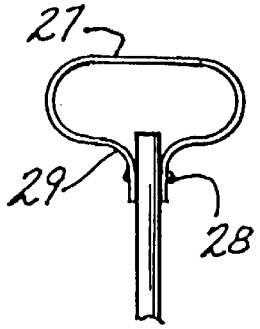
FIG-3
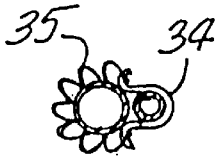
FIG-2

PORTABLE UNISEX URINAL

FIELD OF THE INVENTION

This invention relates to a portable unisex urinal which is light in weight, easily transportable and which may easily be secured in place in almost any location.

BACKGROUND OF THE INVENTION

There is a need for portable urinals in many activities. This is evidenced by the existence of prior art as exemplified by U.S. Pat. Nos. 2,956,287; 4,121,306; 4,422,188; 5,007,116; 5,010,599; 5,285,532; 5,551,097; 5,655,229 and 5,685 229.

All of the devices disclosed in these U.S. Patents and the use there of have one or more limitations such as weight, ease of transportation, awkward to empty, require supports, awkward to use and/or difficult to secure in a given place.

Accordingly, the present invention provides a new and improved portable unisex urinal which is very light in weight and easily movable and transportable, may be easily secured in place in a vehicle such as a van or boat, used on overnight camping trips and at home by a person having an urination problem, to mention only a few examples of use. A device embodying the invention utilizes a urinal receptacle which is easily disengaged from the overall device for purpose of disposing of the contents and which is of generally simplified construction. The urine input member is vertically adjustable for height and the input opening thereof resides in a plane which is angularly adjustable to accommodate the user. Moreover, a urinal embodying the invention is easily disassembled for compact storage when not in use.

An object of this invention is to provide a new and improved lightweight portable urinal.

Another object of this invention is to provide a portable urinal having new and improved means for height adjustment of the urine receptacle.

A further object of this invention is to provide a urinal of the type described where the urine input member is angularly adjustable to accommodate the user.

A still further object of this invention is to provide a portable urinal of new and improved construction which permits easy removal of a urine reservoir for purposes of disposal of the urine.

A still further object of this invention is to provide a lightweight portable urinal which may easily be disassembled for compact storage

SUMMARY OF THE INVENTION

Briefly stated, the invention, in one form thereof, comprises an open top bucket-like member with a shaft fastened to and extending upwardly therefrom, a urine input member having a generally funnel shaped upper portion and a lower flexible portion is slideaby mounted to the shaft, a urine receptacle is disposed on the bucket-like member and removable therefrom, tubing extends from a lower portion of the input member to the receptacle and is removable from the receptacle and means are in or attached to the bucket-like member for stabilizing the device in a given position. The receptacle is removable from the bucket-like member for emptying and is replaceable therein or replaceable with another receptacle. The urine input member includes a flexible portion which permits adjustment of the angle of the open top thereof.

The invention is particularly pointed out and distinctly claimed in the concluding portion of this specification. The invention, however, together with further objects and advantages thereof may be best appreciated by reference to the following detailed description taken in conjunction with the drawings.

BRIEF DESCRIPTION OF THE DRAWINGS

FIG. 1 is a view in elevation of a device embodying the invention with a portion thereof in half section;

FIG. 2 is a view seen in the plane of lines 2—2 of FIG. 1;

FIG. 3 is a view seen in the plane of lines 3—3 of FIG. 1; and

FIG. 4 is a view seen in the plane of lines 4—4 of FIG. 1.

DETAILED DESCRIPTION OF PREFERRED EMBODIMENT OF THE INVENTION

Reference is now made to FIG. 1 which illustrates a portable unisex urinal 10 embodying the invention. The device 10 comprises a base in the form of a tub-like or bucket member 11, shown in half section, with an upstanding cylindrical rod or shaft 12 which permits height adjustment of an upper funnel shaped portion 13 of urinal input member 20, as hereinafter described. Shaft 12 may be positioned inside or outside of member 11, as shown. Shaft 12 is attached to member 11 as by means of fasteners indicated by the reference numerals 14. Member 11 preferably has a cylindrical side wall.

Disposed within member 11 is a urine receptacle or reservoir 15. Receptacle 15 is shown in the form of a common one gallon plastic bottle or jug of a type used for milk or other liquid . Receptacle 15 has a handle 16 for easy removal and handling. Receptacle 15 further includes an upper neck 17 and a removable closure or cap 18 thereon. A small vent hole (not shown) is defined in cap 18 to relieve air pressure in receptacle 15.

Urinal funnel shaped portion 13 is a part of input member 20 which preferably has a generally rectangular upper opening 21 as shown in FIG. 4. Member 20 may be a commercial oil filler funnel. Member 20 further comprises a neck portion 22 leading to an annularly pleated or accordion configured flexible portion 23 which further leads to a lower frustro-conical shaped bottom outlet 24. Flexible portion 23 is defined by the pleats having ridges and valleys. The flexibility of portion 23 of urine input member 20 permits bending thereof so that funnel portion 13 may be angularly positioned, as indicated by the double headed arrow A. A flexible tube 25, preferably of plastic, is tightly inserted into outlet 24 and extends through cap 18 into reservoir 15. Input member 20 is height adjustable on shaft 12, as hereinafter described. The tube 25 extends only a short distance (about one inch) into receptacle 15 so there will be no dripping of urine when cap 18 with tube 25 therein is removed from receptacle 15.

For carrying purposes, a handle member 27 is pivotally mounted to the upper end of shaft 12, as shown in FIG. 3, by means of a pin or nut and bolt 28 extending through legs 29 of handle member 27 and the upper end of shaft 12.

As shown in FIG. 2, a spring clip comprising a U-shaped member 34 has ears on the ends of the legs thereof to which are connected to the ends of a helical spring 35. Springs 35 extend about pleated portion 23 in valleys of the pleats. This simplified construction permits sliding of member 20 on shaft 12 for height adjustment of the upper opening, as seen in FIG. 4, of member 20.

The urinal 12 is adapted for portable use as thus far described. When used for its portability, stability may be provided by weighting member 11 with a substance such as sand or cat litter, indicated by the reference numeral 32. In some instances the urinal may be utilized in one place in an environment such as in a van or boat. In such environment member 11 may be permanently fastened to a floor by screws or other fastening means. However, to permit location at a dedicated site and still retain portability, it may be secured to a base or floor by mating hook and loop material commonly known by the trademark Velcro®. Such securing is represented by the reference numeral 33 in FIG. 1.

For use, the device is located where desired. Member 20 is height adjusted by sliding on shaft 12 and upper funnel portion 13 is angularly adjustable as previously described, then the user may relieve him or herself. There will normally be a trap formed in tube 25 to prevent gases from receptacle from escaping, however the trap will disappear when member 20 is moved to the top of shaft 12. To dispose of the content of container, member 20 is moved upwardly on shaft 12 to permit any urine in tube 25 to drain to receptacle 15. Tube 25 is chosen to be of a length which will not have any slack therein to form a trap which would retain urine when member 20 is moved to the top of shaft 12. Then, cap 18 with tube 25 therein is removed from receptacle 15 and the content of receptacle emptied. Tube 25 extends only a short distance through cap to avoid any dripping of urine when cap 18 is removed from receptacle 15. If no disposal facility is readily available the container may be capped and stored until a disposal facility is available. In such case another container 15 is substituted for the removed container for further use of the device.

Receptacle 11 may be molded with a vertical socket to receive shaft 12 and the shaft 12 is secured in the socket by a removable pin. Alternately, shaft 12 may be received in such socket in a tight frictional fit so that when the urinal is picked up the receptacle will be retained on the shaft. With such construction a urinal embodying the invention may be easily disassembled and member 20 placed in container 11 together with clips 34 and springs 35, and the entire device stored in a small space.

By way of example only, specifications of a prototype embodying the invention are given below.

Weight: One and three-quarter (1¾) pounds, without ballast 32

Length of member 20: Eighteen inches (18")

Funnel portion 13: Eight inches (8"), top to first pleat

Frustro-conical portion 24: Five and one quarter inches (5¼") from bottom to lowest pleat Container 11: Diameter—nine inches (9") at top Height—nine inches (9")

It may thus be seen that the objects of the invention set forth above as well as those made apparent are efficiently attained. While preferred embodiments of the invention has been set forth for purposes of disclosure, modifications to the disclosed embodiments as well as other embodiments of the invention may occur to those skilled in the art. Accordingly, the appended claims are intended to cover all modifications to the disclosed embodiments of the invention as well as other embodiments thereof which do not depart from the spirit and scope of the invention.

What is claimed is:

1. A urinal comprising an open top container, a shaft fastened to and extending upwardly from said container, a urine input member having a generally funnel shaped upper portion and a lower flexible portion, means mounting said input member to said shaft for sliding movement thereon, a urine receptacle in said container and removable therefrom, tubing extending from said input member to said receptacle, and means in or attached to said container for stabilizing said urinal in a selected location.

2. The urinal of claim 1 further including a carrying handle affixed to the upper end of said shaft.

3. The urinal of claim 1 wherein said receptacle has a handle thereon.

4. The urinal of claim 1 wherein said tubing is removable from said receptacle.

5. The urinal of claim 1 wherein said receptacle has an upper neck portion with a removable cap thereon and said tubing extends through said cap.

6. The urinal of claim 1 wherein said means mounting said input member to said shaft is resilient.

7. The urinal of claim 1 wherein said upper top portion of said input member is generally rectangular.

8. The urinal of claim 1 wherein said upper top portion generally resides in a plane which is at an angle from the horizontal selected by a user.

9. The urinal of claim 1 wherein said input member includes a flexible portion intermediate the ends thereof, said input member defines a funnel-like portion, said funnel-like portion has upper edges defining an opening residing in a plane and said input member may be bent at said flexible portion to vary the angle of the plane with the horizontal to accommodate the user.

10. The urinal of claim 1 wherein said container defines a vertical socket therein and said shaft is received in said socket.

* * * * *